US011683637B2

(12) United States Patent
Noro

(10) Patent No.: US 11,683,637 B2
(45) Date of Patent: Jun. 20, 2023

(54) SIGNAL CONVERTER

(71) Applicant: YAMAHA CORPORATION, Hamamatsu (JP)

(72) Inventor: Masao Noro, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/701,129

(22) Filed: Mar. 22, 2022

(65) Prior Publication Data

US 2022/0312107 A1 Sep. 29, 2022

(30) Foreign Application Priority Data

Mar. 25, 2021 (JP) ..... JP2021-051087

(51) Int. Cl.

| | |
|---|---|
| ***H04R 1/26*** | (2006.01) |
| ***H04R 9/02*** | (2006.01) |
| ***H04R 9/08*** | (2006.01) |
| ***H04R 7/12*** | (2006.01) |
| ***H04R 1/04*** | (2006.01) |
| ***H04R 3/00*** | (2006.01) |
| ***H04R 9/04*** | (2006.01) |

(52) U.S. Cl.

CPC ..... *H04R 1/265* (2013.01); *H04R 1/04* (2013.01); *H04R 3/00* (2013.01); *H04R 7/12* (2013.01); *H04R 9/025* (2013.01); *H04R 9/046* (2013.01); *H04R 9/08* (2013.01)

(58) Field of Classification Search

None

See application file for complete search history.

(56) References Cited

U.S. PATENT DOCUMENTS

2003/0048920 A1* 3/2003 Van Halteren ..... H04R 9/063 381/186
2016/0295328 A1* 10/2016 Park ..... H04R 19/04
2018/0192217 A1* 7/2018 Hogan ..... H04R 29/003

OTHER PUBLICATIONS

"Speaker Enclosure," Excerpt from Speaker & Enclosure Encyclopedia, new ed., supervised by Tamon Saeki, Seibundo Shinkosha, May 29, 1999. p. 27. Cited in Specification. English translation provided.

* cited by examiner

*Primary Examiner* — Kenny H Truong

(74) *Attorney, Agent, or Firm* — Rossi, Kimms & McDowell LLP

(57) ABSTRACT

A signal converter includes a chamber, a first diaphragm, a second diaphragm, and a first converter. The chamber has a first opening at one end and a second opening at a second end opposite the first end. The first diaphragm is disposed so as to cover the first opening. The second diaphragm is disposed so as to cover the second opening. The first converter is disposed in the chamber and configured to generate a first signal based on a vibration of the first diaphragm.

9 Claims, 2 Drawing Sheets

SIGNAL CONVERTER

CROSS-REFERENCE TO RELATED APPLICATIONS

The present application claims priority under 35 U.S.C. § 119 to Japanese Patent Application No. JP2021-051087 filed Mar. 25, 2021. The contents of this application are incorporated herein by reference in their entirety.

BACKGROUND

Field

The present disclosure relates to a signal converter that converts sound propagating in a medium (e.g., air) into an electrical signal.

Background Art

"Speaker & Enclosure Encyclopedia" (Speaker & Enclosure Encyclopedia, new ed., supervised by Tamon Saeki, Seibundo Shinkosha, May 29, 1999) describes a speaker that emits sound by vibrating a diaphragm in response to an electric signal. This speaker has lowest resonance frequencies F0, which depend on the configuration of the vibration system that supports the diaphragm. The same applies to a microphone that vibrates its diaphragm upon reception of sound and converts the vibration into an electric signal.

When sound of, for example, musical instruments is collected, the lowest resonance frequency optimum for sound collection varies depending on usage such as the type of the musical instrument whose sound is to be collected. Under the circumstances, in a case where there are a plurality of objects having different lowest resonance frequencies optimum for sound collection, it has been necessary to use a plurality of microphones each suitable for a different object.

The present development has been made in view of the above-described circumstances, and has an object to provide a signal converter that realizes frequency characteristics respectively corresponding to a plurality of different lowest resonance frequencies F0.

SUMMARY

One aspect is a signal converter that includes a chamber, a first diaphragm, a second diaphragm, and a first converter. The chamber has a first opening at one end and a second opening at a second end opposite the first end. The first diaphragm is disposed so as to cover the first opening. The second diaphragm is disposed so as to cover the second opening. The first converter is disposed in the chamber and configured to generate a first signal based on a vibration of the first diaphragm.

BRIEF DESCRIPTION OF THE DRAWINGS

A more complete appreciation of the present disclosure and many of the attendant advantages thereof will be readily obtained as the same becomes better understood by reference to the following detailed description when considered in connection with the following figures.

DESCRIPTION OF THE EMBODIMENTS

The present development is applicable to a signal converter.

Figure 1:
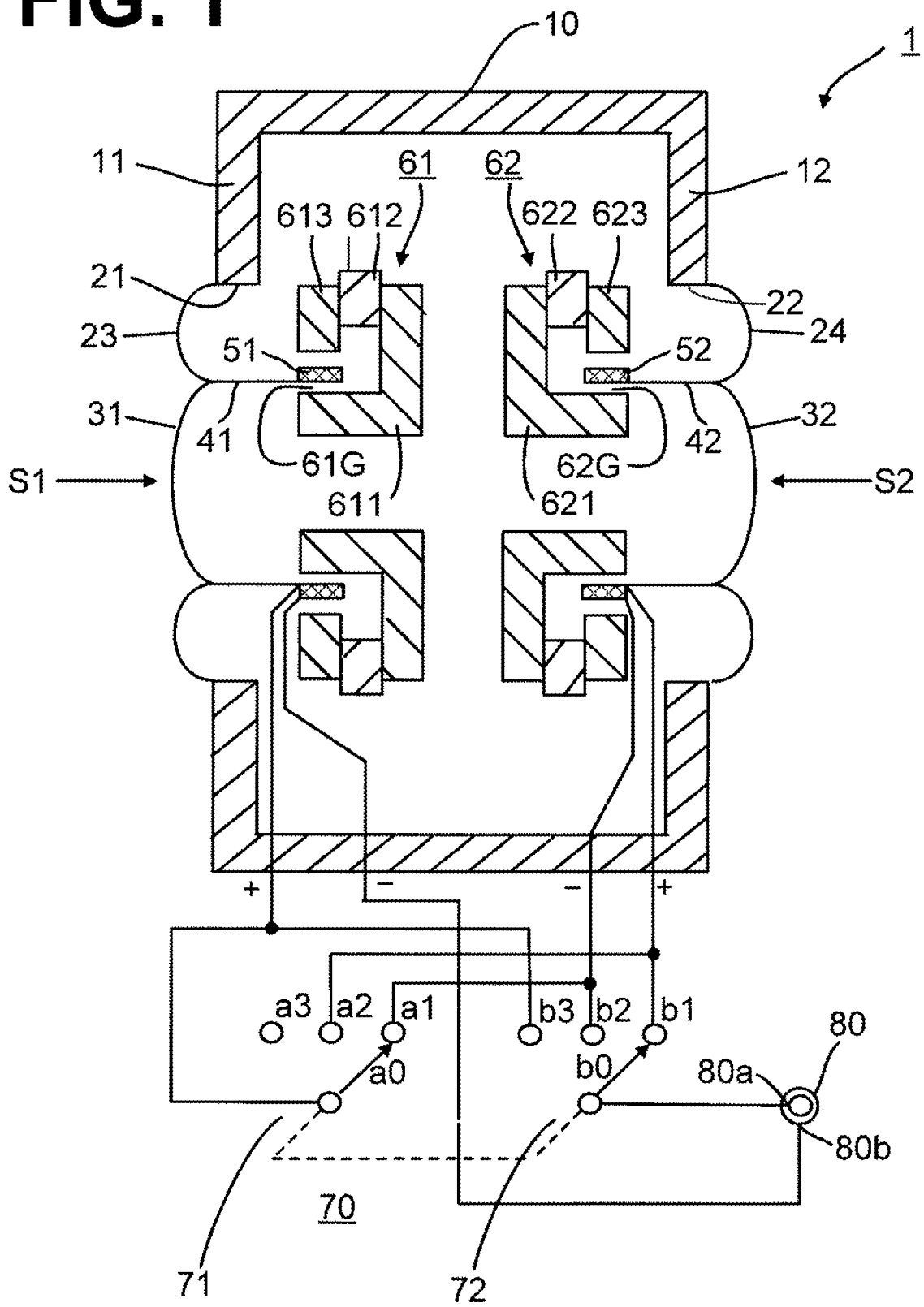
FIG. 1 is a cross-sectional view of a signal converter according to an embodiment of the present disclosure, illustrating a configuration of the signal converter.

The embodiments will now be described with reference to the accompanying drawings, wherein like reference numerals designate corresponding or identical elements throughout the various drawing. FIG. 1 is a cross-sectional view of a signal converter 1 according to an embodiment of the present disclosure, illustrating a configuration of the signal converter 1. FIG. 1 illustrates a cross-section of the signal converter 1 cut along a plane including an imaginary vibration axis passing through the centers of a first diaphragm 31 and a second diaphragm 32.

Referring to FIG. 1, a chamber 10 of the signal converter 1 has a hollow cylindrical shape, and has two circular plates 11 and 12, which have the same size, at both ends in an axial direction (a right-left direction in FIG. 1) of the chamber 10. The circular plate 11 has a circular first opening 21, and the circular plate 12 has a circular second opening 22. The first and second openings 21 and 22 have the same size. The center of the first opening 21 is located at the same position as the center of the circular plate 11, and the center of the second opening 22 is located at the same position as the center of the circular plate 12. It is to be noted that the shape of the chamber may be any other shape, such as a rectangular parallelepiped shape and a spherical shape. The plates 11 and 12 may be a square or rectangular shape, and planar or non-planar.

The first diaphragm 31 has a dome shape, and covers the first opening 21 together with an annular edge 23, which contacts the periphery of the first diaphragm 31. The edge 23 functions as a suspension that supports the first diaphragm at an inner peripheral portion of the first opening 21. Similarly, the second diaphragm 32 has a dome shape, and covers the second opening 22 together with an annular edge 24, which contacts the periphery of the second diaphragm 32. The edge 24 functions as a suspension that supports the second diaphragm at an inner peripheral portion of the second opening 22. The first diaphragm 31 and the second diaphragm 32 are identical to each other in area and weight. It is to be noted that the shape of each diaphragm may be any other shape, such as a conical shape.

A first coil bobbin 41 is provided in a region around the first diaphragm 31. The first coil bobbin 41 has a hollow cylindrical shape, and protrudes toward the inside of the chamber 10. A first coil 51 is wound around the first coil bobbin 41. The first coil 51 is provided in a magnetic gap 61G of a first magnetic circuit 61. The first magnetic circuit 61 includes an inner yoke 611, a permanent magnet 612, and an outer yoke 613. The first coil 51 functions as a first converter that generates a first signal v1 based on vibration of the first diaphragm 31.

Similarly, a second coil bobbin 42 is provided in a region around the second diaphragm 32. The second coil bobbin 42 has a hollow cylindrical shape, and protrudes toward the inside of the chamber 10. A second coil 52 is wound around the second coil bobbin 42. The second coil 52 is provided in a magnetic gap 62G of a second magnetic circuit 62. The second magnetic circuit 62 includes an inner yoke 621, a permanent magnet 622, and an outer yoke 623. The inner yoke 621, the permanent magnet 622, and the outer yoke 623 are respectively similar to the inner yoke 611, the permanent magnet 612, and the outer yoke 613 of the first magnetic circuit 61. The second coil 52 functions as a second converter that generates a second signal v2 based on vibration of the second diaphragm 32. The first magnetic circuit 61 and the second magnetic circuit 62 are fixed to the chamber 10.

A switch device 70 of the signal converter 1 includes a first switch 71 and a second switch 72. The first switch 71 includes a movable contact a0 and fixed contact points a1 to a3. The fixed contact points a1 to a3 are contactable with the movable contact a0. The second switch 72 includes a movable contact b0 and fixed contact points b1 to b3. The fixed contact points b1 to b3 are contactable with the movable contact b0. The first switch 71 and the second switch 72 are such switches that the movable contacts a0 and b0 are movable together. When the movable contact a0 is brought into contact with the fixed contact points a1 to a3, the movable contact b0 is brought into contact with the fixed contact points b1 to b3. The switch device 70 is means for: selecting the first signal v1 from the first coil 51 or the second signal v2 from the second coil 52; and generating an electrical signal to be output to between an inner contact 80*a* and an outer contact 80*b* of a plug 80.

In FIG. 1, one wire is connected to one end of the first coil 51, and another wire is connected to the other end of the first coil 51. Similarly, one wire is connected to one end of the second coil 52, and another wire is connected to the other end of the second coil 52. The one wires are marked "+", and the another wires are marked "—". The symbols "+" and "—" indicate the polarity of the first signal v1, which is generated by the first coil 51, and the polarity of the second signal v2, which is generated by the second coil 52, under the conditions that the first coil 51 moves in a direction toward the second diaphragm 32 and that the second coil 52 moves in a direction toward the first diaphragm 31 (which is a moving direction opposite to the moving direction of the first coil 51). That is, in a case where the first coil 51 moves in a direction toward the second diaphragm 32 and the second coil 52 moves in a direction toward the first diaphragm 31, the first coil 51 and the second coil 52 each function as a voltage source that has a positive electrode connected to the wire marked "+" and a negative electrode connected to the wire marked "—". With this configuration, the voltage source generates the first signal v1 or the second signal v2. For convenience of description, the one end of the first coil 51 or the second coil 52 connected to the wire marked "+" will be hereinafter referred to as positive electrode, and the other end of the first coil 51 or the second coil 52 connected to the wire marked "—" will be hereinafter referred to as negative electrode.

The positive electrode of the first coil 51 is connected to the movable contact a0 and the fixed contact point b3. The negative electrode of the first coil 51 is connected to the outer contact 80*b* of the plug 80. The positive electrode of the second coil 52 is connected to the fixed contact points a2 and b1. The negative electrode of the second coil 52 is connected to the fixed contact points a1 and b2.

With this configuration, in a case where the movable contact a0 has come into contact with the fixed contact point a1 and where the movable contact b0 has come into contact with the fixed contact point b1, the inner contact 80*a* of the plug 80 reaches the outer contact 80*b* of the plug 80 through a path made up of the movable contact b0→the fixed contact point b1→the positive electrode of the second coil 52→the negative electrode of the second coil 52→the fixed contact point a1→the movable contact a0→the positive electrode of the first coil 51→the negative electrode of the first coil 51. In this case, the switch device 70 functions as an adder that adds the first signal v1 and the second signal v2 with the polarities same as each other and that outputs the sum voltage of the first signal v1 and the second signal v2 between the inner contact 80*a* and the outer contact 80*b* of the plug 80.

In a case where the movable contact a0 has come into contact with the fixed contact point a2 and where the movable contact b0 has come into contact with the fixed contact point b2, the inner contact 80*a* of the plug 80 reaches the outer contact 80*b* of the plug 80 through a path made up of the movable contact b0→the fixed contact point b2→the negative electrode of the second coil 52→the positive electrode of the second coil 52→the fixed contact point a2→the movable contact a0→the positive electrode of the first coil 51→the negative electrode of the first coil 51. In this case, the switch device 70 functions as a subtractor that subtracts the second signal v1 from the first signal v2, that is, adds the first signal v1 and the second signal v2 with the polarities opposite from each other, and that outputs, between the inner contact 80*a* and the outer contact 80*b* of the plug 80, the difference voltage between the first signal v1 and the second signal v2.

In a case where the movable contact a0 has come into contact with the fixed contact point a3 and where the movable contact b0 has come into contact with the fixed contact point b3, the inner contact 80*a* of the plug 80 reaches the outer contact 80*b* of the plug 80 through a path made up of the movable contact b0→the fixed contact point b3→the positive electrode of the first coil 51→the negative electrode of the first coil 51. In this case, the first signal v1 is output to between the inner contact 80*a* and the outer contact 80*b* of the plug 80.

An operation of the signal converter 1 according to this embodiment will be described. Referring to FIG. 1, S1 is sound given to the first diaphragm 31, and S2 is sound given to the second diaphragm 32. The sound S1 and the sound S2 include in-phase components. Due to the in-phase components, a first resonance mode is generated in the chamber 10, causing the first diaphragm 31 and the second diaphragm 32 to move in the same direction. As used herein, to "move in the same direction" is intended to mean that the direction of relative movement of the first diaphragm 31 with respect to the magnetic gap 61G is the same as the direction of relative movement of the second diaphragm 32 with respect to the magnetic gap 62G. In the following description of the first resonance mode, the in-phase component contained in the sound S1 will be simply referred to as sound S1, and the in-phase component contained in the sound S2 will be simply referred to as sound S2, for ease of description.

In the first resonance mode, when the pressure of the sound S1, which is a compressional wave (wave of condensation and rarefaction) of air, increases, the first diaphragm 31 is caused to move in a direction in which air is pushed into the chamber 10. At the same time, the pressure of the sound S2 increases, causing the second diaphragm 32 to move in a direction in which air is pushed into the chamber 10. This causes the air in the chamber 10 to be forcefully compressed by the first diaphragm 31 and the second diaphragm 32.

As the pressure of the sound S1 decreases and the first diaphragm 31 moves in a direction in which air is drawn out of the chamber 10, the pressure of the sound S2 also decreases and the second diaphragm 32 moves in a direction in which air is drawn out of the chamber 10. This causes the air in the chamber 10 to be forcefully expanded by the first diaphragm 31 and the second diaphragm 32.

In this manner, in the first resonance mode, the air in the chamber 10 acts more powerfully as an air spring, resulting in a higher lowest resonance frequency F0. Since the first diaphragm 31 and the second diaphragm 32 vibrate in the same direction, the first signal v1 and the second signal v2, which are respectively output from the first coil 51 and the second coil 52, are in-phase with respect to each other.

In contrast, a second resonance mode is generated due to the difference between the sound S1 and the sound S2, and in the second resonance mode, the first diaphragm 31 and the second diaphragm 32 move in opposite directions. As used herein, to "move in opposite directions" is intended to mean that the direction of relative movement of the first diaphragm 31 with respect to the magnetic gap 61G is opposite to the direction of relative movement of the second diaphragm 32 with respect to the magnetic gap 62G. When the pressure of the sound S1 increases beyond the pressure of the sound S2, the first diaphragm 31 moves in a direction in which air is pushed into the chamber 10, and the second diaphragm 32 moves in a direction in which air is drawn out of the chamber 10.

Then, when the pressure of the sound S2 increases beyond the pressure of the sound S1, the second diaphragm 32 moves in a direction in which air is pushed into the chamber 10, and the first diaphragm 32 moves in a direction in which air is drawn out of the chamber 10. Thus, since the first diaphragm 31 and the second diaphragm 32 move in opposite directions, the air in the chamber does not act as an air spring, but rather as a load mass on the two diaphragms.

In this manner, in the second resonance mode, the air in the chamber 10 acts as a load mass, resulting in a lower lowest resonance frequency F0. Since the first diaphragm 31 and the second diaphragm 32 vibrate in opposite directions, the first signal v1 and the second signal v2, which are respectively output from the first coil 51 and the second coil 52, are opposite in phase.

In the signal converter 1 illustrated in FIG. 1, assume a case where a low-frequency sound source (such as a bass drum, not illustrated) is placed in front of the first diaphragm 31 (to the left of the first diaphragm 31 in FIG. 1) (this arrangement of the signal converter 1 with respect to the sound source will be referred to as first arrangement). In this case, strong sound 51 from the sound source reaches the first diaphragm 31, while sound S2 weaker than the sound 51 and substantially in-phase with respect to the sound 51 reaches the second diaphragm 32 (the in-phase is because the distance between the first diaphragm 31 and the second diaphragm 32 is small, considering the sound wavelength). As a result, the first resonance mode and the second resonance mode are generated simultaneously. In this case, each of the first signal v1, which is generated by the first coil 51, and the second signal v2, which is generated by the second coil 52, includes a signal corresponding to vibration in the first resonance mode and a signal corresponding to vibration in the second resonance mode.

This configuration ensures that by selecting one of the first signal v1 and the second signal v2 using the switch device 70, such a signal can be obtained from the signal converter 1 that includes a signal corresponding to vibration in the first resonance mode and a signal corresponding to vibration in the second resonance mode. The above configuration also ensures that by adding, using the switch device 70, the first signal v1 and the second signal v2 with the polarities same as each other, a signal (a fourth signal) indicating vibration in the first resonance mode can be obtained, and that by adding the first signal v1 and the second signal v2 with the polarities opposite from each other, a signal (a third signal) indicating vibration in the second resonance mode can be obtained.

Figure 2:
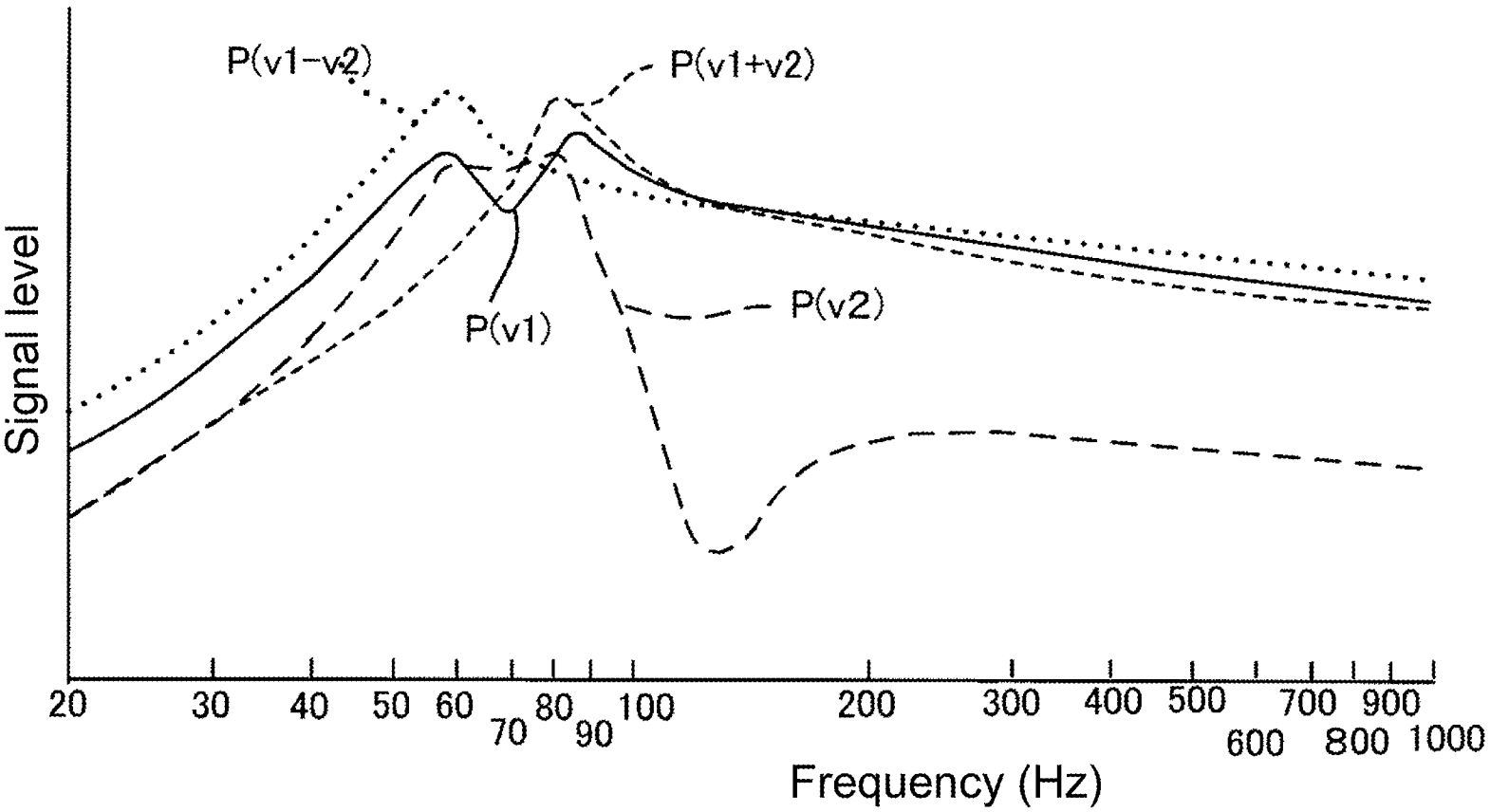
FIG. 2 is a graph of frequency characteristics of the signal converter.

The inventor of the present application conducted a simulation study to evaluate frequency characteristics of various signals obtained in the signal converter 1 in a case where sound from a sound source has reached the signal converter 1 from the direction of the first diaphragm 31. FIG. 2 illustrates frequency characteristics of these signals. In FIG. 2, the horizontal axis represents frequency and the vertical axis represents various signal levels obtained in the signal converter 1.

Referring to FIG. 2, frequency characteristic P(v1) is a frequency characteristic of the first signal v1. The frequency characteristic P(v1) is a double-peaked frequency characteristic having peaks at or around 60 Hz and at or around 85 Hz. Specifically, the peak at or around 60 Hz corresponds to lowest resonance frequency F0 in the second resonance mode, and the peak at or around 85 Hz corresponds to lowest resonance frequency F0 in the first resonance mode. Thus, in this embodiment, the first signal v1, which is obtained from the first coil 51, includes a signal corresponding to vibration in the first resonance mode and a signal corresponding to vibration in the second resonance mode. The first signal v1 is output to the plug 80 by bringing the movable contact a0 into contact with the fixed contact point a3 and bringing the movable contact b0 into contact with the fixed contact point b3.

It is to be noted that the components of the first signal v1 are adjustable by changing the arrangement of the signal converter 1 illustrated in FIG. 1 with respect to the sound source. For example, assume a case where the distance between the sound source and the first diaphragm is the same as the distance between the sound source and the second diaphragm (this arrangement of the signal converter 1 with respect to the sound source will be referred to as second arrangement). In this case, the sound 51 and the sound S2 reaching the respective two diaphragms have many in-phase components and a small difference. As a result, the two diaphragms vibrate mainly in the first resonance mode, and the first signal v1 has many components in the first resonance mode. By adjusting the arrangement of the sound-signal transducer with respect to the sound source between the first arrangement and the second arrangement, the proportion of the first and second resonance-mode components contained in the first signal v1 can be varied.

Further, assume such an arrangement that the sound S2 from the sound source to the second diaphragm is blocked by a plate such as a baffle plate so that only the sound S1 from the sound source reaches the first diaphragm. In this arrangement, there is a large difference between the sound S1 and the sound S2 reaching the respective two diaphragms and a small number of in-phase components. As a result, the two diaphragms vibrate mainly in the second mode, and the obtained first signal v1 contains many components in the second resonance mode. By changing the degree of shielding implemented by the baffle plate, the ratio of the first and second resonance-mode components contained in the first signal v1 can be varied.

Frequency characteristic P(v2) is a frequency characteristic of the second signal v2. Similarly to the frequency characteristic P(v1), the frequency characteristic P(v2) is a double-peaked frequency characteristic having peaks at or around 60 Hz and 85 Hz. Thus, the second signal v2, which is obtained from the second coil 52, includes a signal corresponding to vibration in the first resonance mode and a signal corresponding to vibration in the second resonance mode. The second signal v2 may be output to the plug 80.

Frequency characteristic P(v1−v2) is a frequency characteristic of a signal (v1−v2), which is obtained by subtracting the second signal v2 from the first signal v1, that is, by adding the signals v1 and v2 with the polarities opposite from each other. The frequency characteristic P(v1−v2) is a single-peaked frequency characteristic having a peak at the lowest resonance frequency F0 (at or around 60 Hz) of the second resonance mode.

As described above, the first signal v1 and the second signal v2 both include a signal corresponding to vibration in the first resonance mode and a signal corresponding to vibration in the second resonance mode. The signal corresponding to the first resonance mode in the first signal v1 is in-phase with respect to the signal corresponding to the first resonance mode in the second signal v2. Also, the signal corresponding to the second resonance mode in the first signal v1 is opposite in phase to the signal corresponding to the second resonance mode in the second signal v2. With this configuration, if the first signal v1 and the second signal are reversed-phase added, the signal corresponding to vibration in the first resonance mode in the first signal v1 and the signal corresponding to vibration in the first resonance mode in the second signal v2 cancel each other. This causes the second resonance mode to be emphasized, with a result that a third signal corresponding to vibration in the second resonance mode is obtained. The signals corresponding to vibration in the second resonance mode are output to the plug 80 by bringing the movable contact a0 into contact with the fixed contact point a2 and bringing the movable contact b0 into contact with the fixed contact point b2.

Frequency characteristic P(v1+v2) is a frequency characteristic of a signal (v1+v2), which is obtained by adding the first signal v1 and the second signal v2 with the polarities same as each other. The frequency characteristic P(v1+v2) is a single-peaked frequency characteristic having a peak at the lowest resonance frequency F0 (at or around 85 Hz) of the first resonance mode.

When the first signal v1 and the second signal v2 are in-phase added, the signal corresponding to vibration in the second resonance mode in the first signal v1 and the signal corresponding to vibration in the second resonance mode in the second signal v2 cancel each other. This causes the first resonance mode to be emphasized, with a result that a fourth signal corresponding to vibration in the first resonance mode is obtained. The fourth signals corresponding to vibration in the first resonance mode are output to the plug 80 by bringing the movable contact a0 into contact with the fixed contact point a1 and bringing the movable contact b0 into contact with the fixed contact point b1.

Thus, in this embodiment, a signal having frequency characteristics with two lowest resonance frequencies is obtained in the signal converter 1. Also in this embodiment, a signal having one of the two lowest resonance frequencies F0 can be selectively obtained from the signal converter 1 by a switching operation of the switch device 70.

Other Embodiments

It is to be noted that the above-described embodiment has been provided for exemplary purposes only and that there are various other possible embodiments, some of which will be described below.

(1) In the above-described embodiment, the first diaphragm 31 and the second diaphragm 32 are respectively provided at the circular plates 11 and 12, which are provided on opposite sides of the chamber 10. Another possible embodiment is that the first diaphragm 31 and the second diaphragm 32 are provided at the same plate.

(2) In the above-described embodiment, the first coil 51, the magnetic circuit 61, the second coil 52, and the magnetic circuit 52 are provided inside the chamber 10. Another possible embodiment is that these elements are provided outside the chamber 10.

(3) In the above-described embodiment, the switch device 70 may be omitted, and the first signal v1, which is generated by the first coil 51, and the second signal v2, which is generated by the second coil 52, may be output to mutually different plugs. In this case, a mixer external to the signal converter 1 may, based on an instruction from a user, add the first signal v1 and the second signal v2 with the polarities same as each other and output the sum (a fourth signal), add the first signal v1 and the second signal v2 with the polarities opposite from each other and output the difference (a third signal), or output one of the first signal v1 and the second signal v2.

(4) In the above-described embodiment, the present disclosure is applied to a movable-coil dynamic microphone. It is to be noted, however, that the present disclosure is applicable to a wider range of applications beyond movable-coil microphone applications. The present disclosure is also applicable to variable-capacitance microphones, which extract an electric signal from a capacity whose capacitance varies depending on vibration of the diaphragm.

While an embodiment of the present disclosure and modifications of the embodiment have been described, the embodiment and the modifications are intended as illustrative only and are not intended to limit the scope of the present disclosure. It will be understood that the present disclosure can be embodied in other forms without departing from the scope of the present disclosure, and that other omissions, substitutions, additions, and/or alterations can be made to the embodiment and the modification. Thus, these embodiments and modifications thereof are intended to be encompassed by the scope of the present disclosure. The scope of the present disclosure accordingly is to be defined as set forth in the appended claims.

What is claimed is:

1. A signal converter comprising:

a chamber having a first opening at one end and a second opening at a second end opposite the first end;

a first diaphragm disposed so as to cover the first opening;

a second diaphragm disposed so as to cover the second opening;

a first converter disposed in the chamber and configured to generate a first signal based on a vibration of the first diaphragm;

a second converter disposed in the chamber and configured to generate a second signal based on a vibration of the second diaphragm; and a subtractor configured to subtract the first signal from the second signal so as to generate a third signal, wherein the vibrations of the first diaphragm and the second diaphragm have a first resonance mode in which the first diaphragm and the second diaphragm move in a same direction as each other and a second resonance mode in which the first diaphragm and the second diaphragm move in an opposite direction from each other, and wherein, the third signal corresponds to the vibrations in the second resonance mode.

2. The signal converter according to claim 1, wherein the first diaphragm and the second diaphragm are identical in area and weight.

3. The signal converter according to claim 1, further comprising an adder configured to add the first signal and the second signal to generate a fourth signal corresponding to the vibrations in the first resonance mode.

4. The signal converter according to claim 1, further comprising:

a first magnetic circuit disposed in the chamber, the first magnetic circuit having a first magnetic gap; and a first coil bobbin disposed so as to surround the first diaphragm and extend into the first magnetic gap, wherein the first converter is a first coil wrapped around the first coil bobbin.

5. A signal converter comprising:

a chamber having a first opening at one end and a second opening at a second end opposite the first end;

a first diaphragm disposed so as to cover the first opening;

a second diaphragm disposed so as to cover the second opening;

a first converter disposed in the chamber and configured to generate a first signal based on a vibration of the first diaphragm;

a second converter disposed in the chamber and configured to generate a second signal based on a vibration of the second diaphragm; and an adder configured to add the first signal and the second signal to generate a fourth signal, wherein the vibrations of the first diaphragm and the second diaphragm have a first resonance mode in which the first diaphragm and the second diaphragm move in a same direction as each other and a second resonance mode in which the first diaphragm and the second diaphragm move in an opposite direction from each other, and wherein, the fourth signal corresponds to the vibrations in the first resonance mode.

6. The signal converter according to claim 5, wherein the first diaphragm and the second diaphragm are identical in area and weight.

7. The signal converter according to claim 5, further comprising:

a first magnetic circuit disposed in the chamber, the first magnetic circuit having a first magnetic gap; and a first coil bobbin disposed so as to surround the first diaphragm and extend into the first magnetic gap, wherein the first converter is a first coil wrapped around the first coil bobbin.

8. A signal converter comprising:

a chamber having a first opening at one end and a second opening at a second end opposite the first end;

a first diaphragm disposed so as to cover the first opening;

a second diaphragm disposed so as to cover the second opening;

a first converter disposed in the chamber and configured to generate a first signal based on a vibration of the first diaphragm;

a second converter disposed in the chamber and configured to generate a second signal based on a vibration of the second diaphragm;

a first magnetic circuit disposed in the chamber, the first magnetic circuit having a first magnetic gap;

a second magnetic circuit disposed in the chamber, the second magnetic circuit having a second magnetic gap;

a first coil bobbin disposed so as to surround the first diaphragm and extend into the first magnetic gap; and a second coil bobbin disposed so as to surround the second diaphragm and extend into the second magnetic gap;

wherein the first converter is a first coil wrapped around the first coil bobbin, and wherein the second converter is a second coil wrapped around the second coil bobbin.

9. The signal converter according to claim 8, wherein the first diaphragm and the second diaphragm are identical in area and weight.

* * * * *